United States Patent [19]

Kawahara

[11] 4,328,572

[45] May 4, 1982

[54] VOLTAGE CONTROL SYSTEM FOR ELECTRONIC TIMEPIECE

[75] Inventor: Hisashi Kawahara, Tanashi, Japan

[73] Assignee: Citizen Watch Company Limited, Tokyo, Japan

[21] Appl. No.: 176,379

[22] Filed: Aug. 8, 1980

[30] Foreign Application Priority Data

Aug. 14, 1979 [JP] Japan ..... 54-103347
Aug. 14, 1979 [JP] Japan ..... 54-103348

[51] Int. Cl.[3] ..... G04G 3/00

[52] U.S. Cl. ..... 368/204; 368/156; 368/66; 331/185; 331/70

[58] Field of Search ..... 368/204, 203, 66, 85, 368/86, 155, 156, 159, 217, 218, 219; 331/185, 186, 64, 70

[56] References Cited

U.S. PATENT DOCUMENTS 4,221,111 9/1980 Onda et al. ..... 368/66 X
4,226,081 10/1980 Ichikawa ..... 368/66

*Primary Examiner*—B. A. Reynolds
*Assistant Examiner*—Philip H. Leung
*Attorney, Agent, or Firm*—Jordan and Hamburg

[57] ABSTRACT

In an electronic timepiece powered by a lithium battery, a voltage control system is provided whereby a supply voltage of approximately one half of the battery voltage is supplied to certain portions of the timepiece circuit under normal operating conditions, but whereby cessation of operation by the timebase oscillator circuit of the timepiece due to some abnormal state such as excessively low ambient operating temperature is automatically detected and a changeover is made to supply of the full battery voltage to all of the timepiece circuitry. Upon recovery of operation of the timebase oscillator circuit, changeover to the low voltage supply state is performed.

10 Claims, 5 Drawing Figures

| Fig. 3 A | Fig. 3 B |
|---|---|

VOLTAGE CONTROL SYSTEM FOR ELECTRONIC TIMEPIECE

BACKGROUND OF THE INVENTION

At the present time, electronic timepieces, and particularly electronic timepieces having a digital time display, are in widespread use. There is an increasing demand for timepieces which provide a longer battery life, or for smaller timepieces which utilize a smaller size of battery as a power source. One method which has been proposed to accomplish this is to use a lithium battery, rather than the silver oxide type of battery which is generally employed in a conventional timepiece. A lithium battery has the advantage of providing a greater energy capacity than a silver oxide battery of similar size, and also has the important advantage that the rate of internal discharge of the battery while it is not being actually used is much lower than in the case of a silver oxide battery. Thus, the shelf life, or storage life, of a lithium battery is significantly longer than that of a conventional type of electronic timepiece battery.

However, a problem arises in using a lithium battery to directly power an electronic timepiece. This is due to the fact that the voltage provided by a single cell lithium battery is approximately double that of a silver oxide battery, i.e. of the order of 3 volts, as compared with about 1.5 V for a silver oxide battery. Since certain portions of the circuitry of an electronic timepiece which comprise metal oxide silicon field effect transistor elements (usually abbreviated to MOS FETs) can operate effectively with a supply voltage of 1.5 V or less, it is obviously wasteful of battery power to apply the full voltage of a lithium battery directly to such portions of the circuitry. These portions of the timepiece circuitry include the crystal controlled timebase oscillator circuit, the frequency divider circuit, and the timekeeping counter circuit. However it is a feature of such circuits that, if the timebase oscillator circuit (which consumes a substantial proportion of battery power, since the transistors associated with this circuit are switched at a relatively high frequency) is designed to operate at a certain supply voltage (for example, 1.5 V) at maximum efficiency, then it is generally necessary to momentarily supply a somewhat higher supply voltage to the timebase oscillator circuit in order to initiate oscillation. For this reason, a method has been proposed in the prior art for utilizing a lithium battery in an electronic timepiece, whereby a control pulse is produced by a portion of the circuitry for a predetermined time after a battery is installed in the timepiece. While this control pulse is being produced, the full output voltage of the lithium battery is supplied to the timebase oscillator circuit, so operation of the oscillator circuit is initiated. When the control pulse is terminated, after a time determined for example by a resistance-capacitance time constant, then a stepped-down supply voltage is supplied to portions of the timepiece circuitry including the timebase oscillator circuit. The latter stepped-down supply voltage is produced by a circuit which is actuated by a low-frequency signal produced from the frequency divider circuit of the timepiece, and which steps down the output voltage of the lithium battery. Changeover from supply of the full battery voltage to supply of the stepped-down voltage is accomplished by means of a changeover circuit, which is responsive to the control pulse referred to above, i.e. once the control pulse is terminated after the battery has been installed, the changeover circuit begins to supply the timebase oscillator and other circuits with a stepped-down supply voltage, rather than the full battery voltage. However, it is a feature of a lithium battery, as well as most other batteries, that a change in operating conditions, such as a lowering of the ambient operating temperature, will cause a reduction of the battery voltage. Thus, with a timepiece voltage control system such as that just described, it is possible that the battery voltage may fall, due to a change in ambient operating conditions, to such an extent that the stepped-down battery voltage level is insufficient to sustain operation of the timebase oscillator circuit. The oscillator circuit output therefore disappears, so that the voltage step-down circuit ceases to receive an output signal from the frequency divider circuit. In order to restore operation of the timepiece in such a case, it is necessary to remove the timepiece battery and then replace it, thereby again generating an initiating control pulse whereby the full battery voltage is supplied to the timebase oscillator circuit, thereby restarting operation of the oscillator circuit. Such a procedure is obviously troublesome, and in any case could not, in most cases, be performed by the timepiece user.

A modification of the above system has been proposed whereby an external operating member can be actuated to cause a changeover circuit to temporarily supply the full voltage of the lithium battery to the timebase oscillator circuit. This external operating member is actuated in order to initiate operation of the timebase oscillator circuit when a battery is first installed in the timepiece. Furthermore, if the battery voltage should subsequently fall to such an extent that the timebase oscillator ceases to function, due to a change in ambient operating conditions, then operation of the timebase oscillator can be restarted by the user actuating the external control member referred to. Such a system is obviously troublesome and inconvenient to the user. In addition, since it is necessary to incorporate an external operating member in the timepiece, the manufacturing cost will be substantially increased. It is a feature of an electronic timepiece that such components as electronic circuit elements can be added with a negligible increase in manufacturing costs, but that addition of any component such as an externally actuated switch results in a significant increase in cost.

In addition, of course, with either of the systems described above, there will usually be a relatively long time lapse between the cessation of operation of the timebase oscillator circuit and restoration of operation of the timepiece. It will therefore be necessary for the user to reset the current time displayed by the timepiece after operation has been restored. Such systems are therefore inherently undesirable.

With the present invention, the disadvantages of such prior art systems are effectively eliminated. In an electronic timepiece powered by a lithium battery, cessation of operation of the timebase oscillator circuit while a stepped-down supply voltage is being applied to that circuit, is immediately detected, and the full voltage of the lithium battery is supplied to the timebase oscillator circuit. Operation of the oscillator is thereby immediately restored. In addition, the voltage control system of the present invention automatically supplies the full voltage of the lithium battery to the timebase oscillator circuit at the time of initial installation of a battery, and changes over to supply of a stepped-down voltage to the oscillator circuit as soon as operation of that circuit has commenced. No action by the timepiece user, or by the person who instals the battery, is required. A voltage control system according to the present invention therefore offers significant advantages in terms of user convenience, as compared with prior art systems proposed for utilizing a lithium battery in an electronic timepiece. In addition, since no external operating member is required, the use of a voltage control system according to the present invention involves no penalty in terms of increased manufacturing costs.

SUMMARY OF THE INVENTION

The present invention comprises a voltage control system for an electronic timepiece which is powered by a lithium battery. Such a voltage control system acts to detect whether or not an output signal is being produced by the timepiece oscillator circuit of the timepiece. If no output signal is being produced, due to some reason such as the fact that a battery has just been installed so that operation of the timebase oscillator has not yet been initiated, or because the ambient operating temperature has fallen to an excessively low level, then the voltage control system acts to supply certain portions of the timepiece circuit including the timebase oscillator circuit, with the full voltage of the lithium battery as a supply voltage. Operation of the timebase oscillator circuit will then be started, in response to the high supply voltage thus provided. When the voltage control system then detects the fact that an output signal is being produced by the timebase oscillator circuit, the system applies a stepped-down supply voltage to the timebase oscillator circuit and those other circuit sections which can function in a satisfactory way with a lower supply voltage. Conversion of the battery voltage to a stepped-down voltage, which may be of the order of one half of the battery voltage, is performed in a highly efficient manner by a switching type of voltage step-down circuit employing CMOS FET elements. A clock signal detection circuit produces a control signal whose logic level depends upon whether or not an output signal is being produced by the timebase oscillator circuit. This control signal acts to control a changeover circuit to supply either the full voltage of the lithium battery to the timebase oscillator circuit and other circuit sections, or to supply the stepped-down voltage to these circuit sections.

It is a special feature of the present invention that a novel design of changeover circuit is employed, whereby leakage currents between the substrate and certain electrodes of the changeover circuit transistor elements are effectively eliminated, for any combination of control signal logic levels and input and output voltages. Such a reduction of these leakage currents has not been possible with conventional designs of changeover circuits.

The voltage control system acts in a completely automatic and extremely rapid manner to detect cessation of operation by the timebase oscillator circuit. Thus, user convenience is greatly enhanced, by comparison with conventional methods of utilizing a lithium battery in an electronic timepiece, and any loss of timekeeping accuracy due to a temporary cessation of operation of the timebase oscillator circuit is minimized.

DESCRIPTION OF THE PREFERRED EMBODIMENT

Figure 1A:
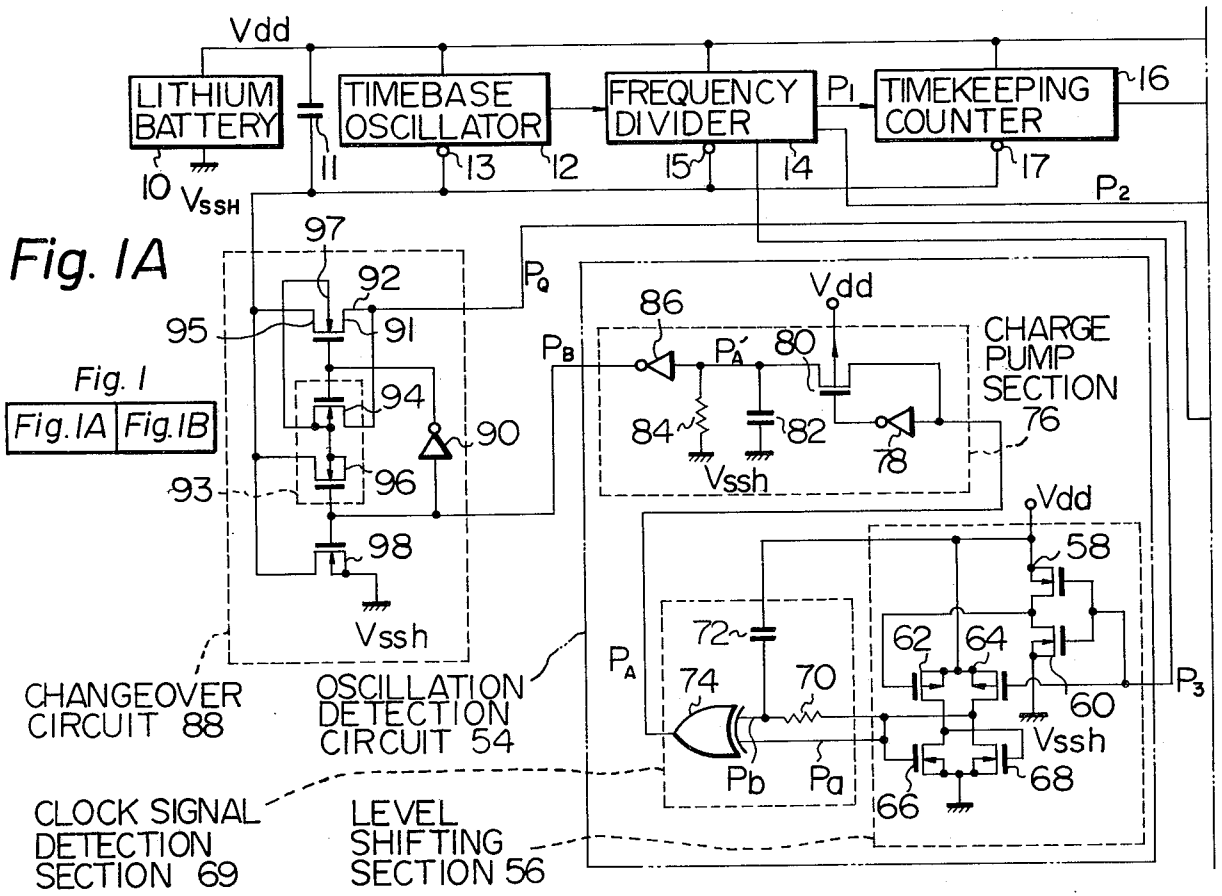
FIG. 1 (FIGS. 1A and 1B) is a circuit diagram illustrating a first embodiment of a voltage control system according to the present invention incorporated in an electronic timepiece.
Figure 1B:
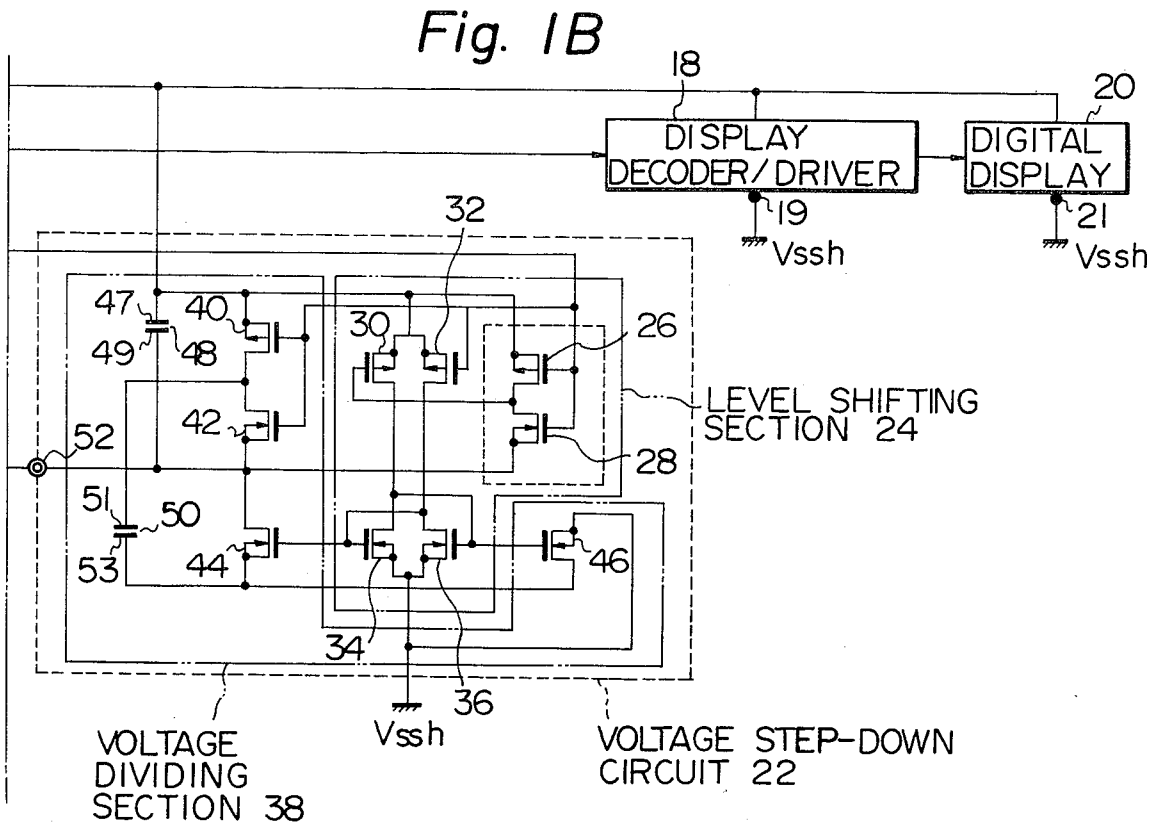

Referring first to FIG. 1, a simplified circuit diagram of an embodiment of the present invention applied to an electronic timepiece having a digital display is shown. Reference numeral 10 denotes a lithium battery, which serves as a power source for the timepiece. Reference numeral 12 denotes a timebase oscillator circuit, which produces a standard frequency timebase signal of relatively high frequency. This timebase signal is applied to a frequency divider circuit 14, which thereby produces a unit time signal $P_1$, having a frequency of one Hz, a first clock pulse signal $P_2$ having a frequency of 512 Hz in the present embodiment, and a second clock pulse signal $P_3$, having a frequency of 1024 Hz. Numeral 16 denotes a timekeeping counter circuit, which receives the unit time signal from frequency divider circuit 14, and thereby produces various time information signals. These are input to a display decoder/driver circuit 18, which thereby produces various drive signals that are applied to the electrodes of an electro-optical digital display device 20.

In FIG. 1, the positive potential of the output voltage from lithium battery 10 is designated as $V_{dd}$, and the negative potential as $V_{ssH}$. The full battery voltage, i.e. $(V_{dd}-V_{ssH})$ is permanently applied as a supply voltage to the display decoder/driver circuit 18 and the digital display 20. As shown, $V_{ssH}$ is applied to a negative supply terminal 19 of display driver/decoder circuit 18, and to a terminal 21 of digital display 20.

Numeral 22 denotes a voltage step-down circuit, which serves to produce a negative supply voltage $V_{ssL}$ which is higher in potential than $V_{ssH}$, in other words to provide a supply having a value $(V_{dd}-V_{ssL})$ which is less than the voltage supplied by lithium battery 10, i.e. $(V_{dd}-V_{ssH})$. Voltage step-down circuit 22 is designed to perform this voltage step-down function at a very high level of efficiency, such that the consumption of battery power in the step-down conversion process is negligible. In voltage step-down circuit 22, reference numeral 24 denotes a level shifting section, enclosed within a chain-line outline. Numeral 25 denotes a complementary MOS transistor inverter within level shifting section 24, enclosed within a broken line rectangle. Numeral 38 denotes a voltage dividing section, which is controlled by signals produced by level shifting section 24 to produce a stepped down output voltage, on an output terminal 52. In the present embodiment, the output potential from voltage step-down circuit, i.e. $V_{ssL}$, has a value which is half of $V_{ssH}$, in other words the magnitude of $(V_{dd}-V_{ssL})$ is one half that of the potential difference between the terminals of lithium battery 10, i.e. $(V_{dd}-V_{ssH})$.

Level shifting section 24 comprises a P-channel MOS FET 26 and an N-channel FET 28, connected to form inverter 25, with the clock signal $P_2$ being applied to the gate terminals of transistors 28 and 26. Clock signal $P_2$ is also applied to the gate of a P-channel transistor 32, while the output from inverter 25, i.e. the inverse of clock signal $P_2$, is applied to the gate of another P-channel transistor 30. The source electrodes of transistors 30 and 32 are connected in common to the $V_{dd}$ potential, i.e. to the positive side of battery 10. Level shifting circuit 24 further comprises two N-channel MOS FETs 34 and 36, the source electrodes of which are connected in common to the $V_{ssH}$ potential. The drain electrode of transistor 34 is connected to the drain of transistor 30, while the drain electrodes of transistors 32 and 36 are connected together.

Voltage dividing section 38 of voltage step-down circuit 22 comprises an N-channel MOS FET 46 whose source is connected to the $V_{ssH}$ potential and whose gate electrode is connected to the common drain electrode connection of transistors 30 and 34. The drain electrode of transistor 46 is connected to one side of a capacitor 50, and to the source electrode of an N-channel MOS FET 44. The gate electrode of transistor 44 is connected to the common drain connection of transistors 32 and 36, while the drain electrode of transistor 44 is connected to one side of a capacitor 48, to the source electrode of an N-channel MOS FET 42, and to the source of N-channel FET 28. The drain electrode of transistor 42 is connected to the drain of an FET 30, the source electrode of which is connected to the $V_{dd}$ potential. The gate electrodes of transistors 40 and 42 are connected in common to receive clock signal $P_2$. The common drain electrode connection of transistors 40 and 42 is coupled to the other end of capacitor 50. The other end of capacitor 48 is connected to the $V_{dd}$ potential. The operation of voltage step-down circuit 22 will now be described. Clock signal $P_2$ is a square-wave signal, which alternates between the $V_{dd}$ and the $V_{ssH}$ potentials at a frequency of 512 Hz. We shall first consider the state of the voltage step-down circuit 22 when clock signal $P_2$ is at the $V_{dd}$ potential, i.e. the positive potential of battery 10. In the following description, the ON state of a CMOS FET will designate the state in which a virtual short-circuit condition exists between the drain and source electrodes, i.e. the saturated state, while the OFF condition will refer to the state in which a virtual open-circuit condition exists between the drain and source electrodes, i.e. the cut-off condition. When clock signal $P_2$ is at the $V_{dd}$ potential, transistor 26, being a P-channel type, will go to the OFF state, while transistor 28 will go to the ON state. As a result, transistor 30, connected to the common drain electrodes of 26 and 28, goes to the ON state, while transistor 32, whose gate receives the $V_{dd}$ level of clock signal $P_2$ is in the OFF state. The $V_{dd}$ potential which thereby appears at the drain of transistor 30 causes transistors 36 and 46 to be in the ON state, while the $V_{ssH}$ potential at the drain of transistor 36 causes transistors 34 and 44 to be in the OFF state. At this time also, clock signal $P_2$ causes transistor 40 to be in the OFF state and transistor 42 to be in the ON state. The result of the above combination of states of the transistors in voltage step-down circuit 22 is that one terminal of capacitor 50, designated by numeral 51, is connected to a terminal 49 of capacitor 48, through transistor 42, and also to output terminal 52 of the circuit. In addition, the other terminal 47 of capacitor 48 is connected to the $V_{dd}$ potential, while the other terminal 53 of capacitor 50 is connected to the $V_{ssH}$ potential through transistor 46.

In this condition, therefore, capacitors 48 and 50 are connected in series between the $V_{dd}$ and $V_{ssH}$ potentials, with the output terminal 52 being connected to the junction of these capacitors. The values of capacitors 48 and 50 are equal, in this embodiment, so that each of capacitors 48 and 50 is charged to the same degree when this condition is attained.

During the next half-cycle of clock signal $P_2$, when this signal is at the $V_{ssH}$ level or the $V_{ssL}$ level the condition of circuit 22 is as follows. Transistors 26 and 28 are in the ON state and OFF state respectively. Similarly, transistors 32 and 36 are in the ON state and the OFF state respectively. Transistor 46 is in the OFF state, while transistor 44 is in the ON state. Transistors 40 and 42 are in the ON state and the OFF state respectively. Thus, terminal 51 of capacitor 50 is connected through transistor 40 to the $V_{dd}$ potential, as is also terminal 47 of capacitor 48. Terminal 53 of capacitor 51 is connected through transistor 44 to the output terminal 52 of the circuit, and hence to the terminal 49 of capacitor 48. It can thus be appreciated that in this condition, capacitors 48 and 50 are connected in parallel, between the $V_{dd}$ potential and output terminal 52.

From the above description it can be understood that successive cycles of clock signal $P_2$ act to alternately connect capacitors 48 and 50 in series between the $V_{dd}$ and $V_{ssH}$ potentials and in parallel between the $V_{dd}$ potential and output terminal 52. The result is that, since capacitors 48 and 50 are repetitively charged to the same degree, and since they have the same capacity value, a voltage whose potential is mid-way between $V_{dd}$ and $V_{ssH}$ appears on terminal 52 of voltage step-down circuit 22. Since only transfer of charge between capacitors 48 and 50 is performed, power consumption in producing the stepped-down voltage $V_{ssL}$ from circuit 22 is negligible, by comparison with conventional step-down circuits.

Numeral 54 denotes an oscillation detection circuit, which serves to produce a control signal, designated $P_b$, whose logic level indicates the presence or absence of an output signal from frequency divider circuit 14, and hence from timebase oscillator circuit 12. Oscillation detection circuit 54 comprises a level shifting section 56, a clock signal detection section 69, and a charge pump section 76. Level shifting section 56 serves to produce an output signal having the same frequency as clock signal $P_3$, but which alternates between the $V_{dd}$ level and the $V_{ssH}$ level irrespective of whether the $V_{ssH}$ or the $V_{ssL}$ potential is being supplied to terminal 15 of frequency divider 14, i.e. irrespective of whether clock signal $P_3$ is alternating between the $V_{dd}$ and $V_{ssH}$ or between the $V_{dd}$ and $V_{ssL}$ potentials. Level shifting section 56 comprises an inverter comprising a P-channel MOS FET 58 and an N-channel FET 60, with the source terminals of transistors 58 and 60 being connected to the $V_{dd}$ and the $V_{ssH}$ potentials respectively. Clock signal $P_3$ is applied to the common gate electrodes of transistors 58 and 60, and also to the gate of a P-channel MOS FET 64. The common drain connection of transistors 58 and 60 is coupled to the gate of another P-channel transistor 62. The drain electrode of transistor 62 is connected to the gate electrode of an N-channel FET 68, and to the drain electrode of another N-channel FET 66. The drain of transistor 64 is connected to the drain of transistor 68, and also to the gate electrode of transistor 66. The source electrodes of transistors 62 and 64 are connected in common to the $V_{dd}$ potential, while the source electrodes of transistors 66 and 68 are connected in common to the $V_{ssH}$ potential.

Clock signal detection section 69 comprises an exclusive-OR gate 74 having one input connected to the junction of a resistor 70 and a capacitor 72. The other input of exclusive-OR gate 74 is connected to the common drain electrodes of transistors 64 and 68 of level shifting section 56, to receive signal Pa produced therefrom. The latter input of exclusive OR gate 74 is also connected to the other end of resistor 70. The other end of capacitor 72 is connected to the $V_{dd}$ potential, while the output of exclusive-OR gate 74 is a pulse signal denoted as $P_A$.

Signal $P_A$ is applied to charge pump section 76. This comprises an inverter 78, whose input is coupled to receive signal $P_A$, a P-channel MOS FET 80, whose source electrode is connected to the input of inverter 78 and whose gate electrode is connected to the output of inverter 78. The substrate of transistor 80 is connected to the $V_{dd}$ potential. The drain electrode of transistor 80 is connected to one end of a capacitor 82, to one end of a resistor 84, and to the input of an inverter 86. The other ends of capacitor 82 and resistor 84 are connected to the $V_{ssH}$ potential.

Figure 2:
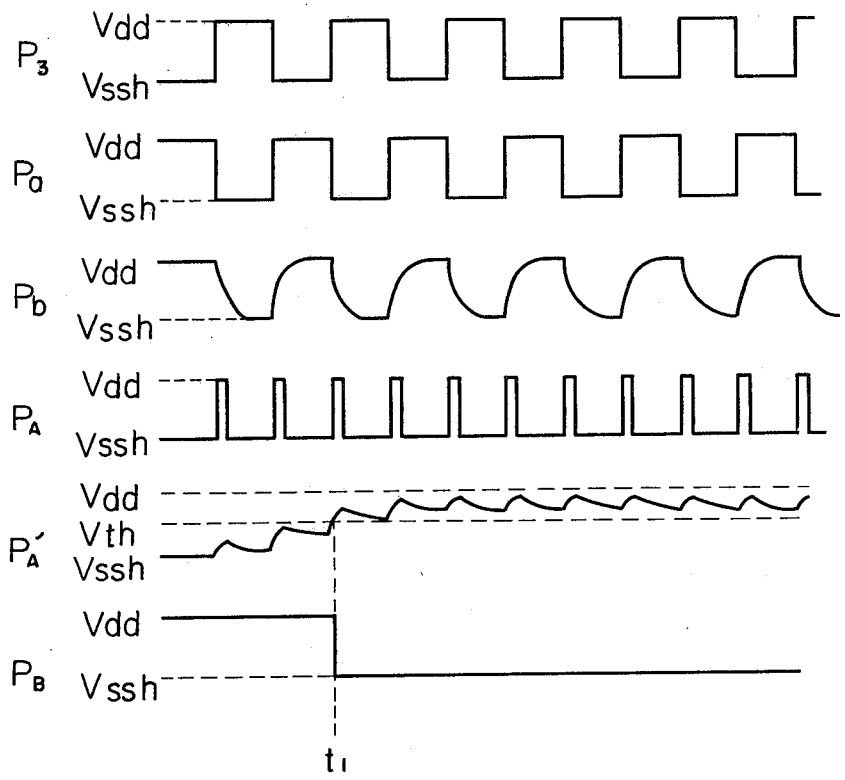
FIG. 2 is a waveform diagram to assist in understanding the operation of the circuit of FIG. 1.

The operation of oscillation detection circuit 54 will now be described, with reference to the waveform diagram of FIG. 2. As shown in FIG. 2, clock signal $P_3$ is a square wave signal which alternates between the $V_{dd}$ level and either the $V_{ssH}$ level (when the $V_{ssH}$ potential is applied to terminal 15 of frequency divider circuit 14 or the $V_{ssL}$ level (when the $V_{ssL}$ potential is applied to terminal 15 of frequency divider 14). Each time clock signal $P_3$ goes to the $V_{dd}$ level, transistor 60 goes to the ON state, thereby setting the gate electrode of transistor 62 to a low potential level, so that transistor 62 also goes to the ON state. The $V_{dd}$ potential is thereby applied to the gate of transistor 68, which thereby is switched to the ON state, so that the drain of transistor 68 goes to the $V_{ssH}$ potential, i.e. signal Pa goes to the $V_{ssH}$ level. When signal $P_3$ goes to the $V_{ssH}$ (or $V_{ssL}$) level, on the other hand, transistor 58 goes to the ON state, so that transistor 62 is switched OFF, while transistor 64 goes to the ON state. The $V_{dd}$ potential therefore appears at the drain electrode of transistor 64, i.e. signal Pa goes to the $V_{dd}$ level. It can thus be seen that signal Pa corresponds to signal $P_3$, shifted in phase by 180° C., but that signal Pa always alternates between the $V_{dd}$ and the $V_{ssH}$ levels.

Signal Pa is integrated by the combination of resistor 70 and capacitor 72, to produce a control signal having the waveform denoted as Pb, shown in FIG. 2. During each time interval after signal Pa has fallen to the $V_{ssH}$ level but before signal Pb has fallen to the threshold level of exclusive-OR gate 74 (i.e. while exclusive-OR gate 74 still judges that signal Pb is still at the high potential level), an output pulse of relatively narrow width is produced by exclusive-OR gate 74, since exclusive-OR gate 76 receives signals Pa and Pb to be at different logic level potentials during each of these time intervals. Thus, a train of narrow pulses $P_A$ is output by exclusive-OR gate 74.

Each time one of pulses $P_A$ occurs, the output of inverter 78 goes to the low potential level, i.e. to the $V_{ssH}$ potential, so that transistor 80 of charge pump circuit 76 goes to the ON state. Thus, during each of the pulses of signal $P_A$, a small amount of charge is transferred into capacitor 82, so that if the potential level of the input to inverter 86 (denotes as signal $P_A'$) is initially at the $V_{ssH}$ level, this potential will gradually increase in stepwise manner toward a maximum value, less than $V_{dd}$, as shown in FIG. 2, since capacitor 82 discharges slightly through resistor 84 between successive pulses of signal $P_A$. Between successive $P_A$ pulses, the gate potential of transistor 80 goes to the $V_{dd}$ level, so that transistor 80 goes to the OFF state. Inverter 86 serves to perform threshold detection of the voltage appearing across capacitor 82, i.e. signal $P_A'$. As shown in FIG. 2, while signal $P_A'$ is below the threshold voltage $V_{th}$ of inverter 86, the output of inverter 86, signal $P_B$, is at the $V_{dd}$ potential. When signal $P_A'$ reaches this threshold voltage level, in rising from potential $V_{ssH}$, the output of inverter 86 goes to the $V_{ssH}$ level.

If, subsequently, timebase oscillator circuit 12 should cease to operate, then signal $P_3$ will attain a DC potential, either at the $V_{dd}$ or at the $V_{ssL}$ level. In this case, it can be seen that both inputs to exclusive-OR gate 74 will be held at either the $V_{ssH}$ or the $V_{dd}$ level, i.e. both inputs will be at the same logic level potential. As a result, the output of exclusive-OR gate 74 will go to the low potential level, i.e. $V_{ssH}$, and remain at that level, so that no more pulses are applied as signal $P_A$ to charge pump section 76. Capacitor 82 will then rapidly discharge to the $V_{ssH}$ level, through resisotr 84, so that the output of inverter 86, i.e. signal $P_B$, will go to the $V_{dd}$ potential, and remain there.

From the above, it can be understood that so long as timebase oscillator circuit 12 is operating, then signal $P_B$ from oscillation detection circuit 54 will be at the $V_{ssH}$ level. If oscillator circuit 12 should cease to oscillate, then signal $P_B$ will rapidly go to the $V_{dd}$ potential, and remain there. if timebase oscillator circuit 12 subsequently begins operation once more, then signal $P_B$ will rapidly go to the $V_{ssH}$ level, and remain there.

Numeral 88 denotes a changeover circuit, which is responsive to control signal $P_B$ from oscillation detection circuit 54 for applying either potential $V_{ssH}$ or $V_{ssL}$ to negative supply voltage terminals 13, 15 and 17 of timebase oscillator circuit 12, frequency divider circuit 14, and timekeeping counter circuit 16. Changeover circuit 88 comprises an inverter 90, coupled to receive signal $P_B$, a first N-channel MOS FET 92 whose source electrode is coupled to output terminal 52 of voltage step-down circuit 22 and whose drain electrode is connected to the negative supply voltage terminals 13, 15 and 17 of timebase oscillator circuit 12, frequency divider circuit 14 and timekeeping counter 16 respectively. The gate electrode of transistor 92 is connected to the output of inverter 90, and to the gate of a second N-channel MOS FET 94. The drain electrode of transistor 96 is connected to the source electrode of transistor 92, while its source electrode is connected to the substrate and to the substrate of transistor 92. The latter substrate is not connected to the source or drain electrodes of transistor 92. The source electrode of transistor 94 is also connected to the substrate and source electrodes of a third N-channel transistor 96, whose drain electrode is connected to the drain of transistor 92. The gate electrode of transistor 96 is connected to the input of inverter 90 (i.e. to receive signal $P_B$) and also to the gate electrode of a fourth N-channel MOS FET 98. The source and substrate of transistor 98 are connected to the $V_{ssH}$ potential. The drain electrode of transistor 98 is connected to the common drain electrodes of transistors 92 and 96.

Numeral 11 denotes a capacitor connected between the output from changeover circuit 88 and the $V_{dd}$ potential.

The operation of the timepiece circuit of FIG. 1 will now be described. It will be first assumed that a lithium battery 10 is to be inserted into the timepiece, in order to initiate operation. Immediately after battery 10 is inserted, before timebase oscillator circuit 12 has started to oscillate, the output from frequency divider circuit 14 will be a steady-state signal, at some DC potential. Thus, each of the input applied to exclusive-OR gate 74 of oscillation detection circuit 54 will be at the same potential. The output from exclusive-OR gate 74, i.e. signal $P_A$, cannot rise to the $V_{dd}$ level at this time, therefore, so that no charging of capacitor 82 will occur. The output from inverter 86 of oscillation detection circuit 54, i.e. signal $P_B$, will therefore be at the $V_{dd}$ potential immediately after battery 10 is first inserted. As a result, transistor 98 and transistor 96 will be in the ON state, while the transistors 92 and 94, which at this time are receiving the $V_{ssH}$ potential from the output of inverter 90 at their gate electrodes, will be in the OFF state. Thus, the $V_{ssH}$ potential will be applied through transistor 98 to charge capacitor 11 and to the negative voltage supply terminals 13, 15 and 17 of the timebase oscillator circuit 12, frequency divider circuit 14, and timekeeping counter circuit 16. Shortly thereafter, timebase oscillator circuit 12 will begin operation, in response to the supply voltage of value ($V_{dd}$–$V_{ssH}$) which is being applied to it. As a result, a pulse train signal $P_2$ will begin to be supplied to voltage step-down circuit 22. A stepped down voltage, $V_{ssL}$ will therefore appear at the output terminal 52 of voltage step-down circuit 22, as this circuit comes to operate in response to signal $P_2$ as has been described hereinabove. At this time also, pulse train signal $P_3$ is being produced from frequency divider circuit 14, and supplied to the input of oscillation detection circuit 54. A train of narrow width pulses $P_A$ is thereby output from exclusive-OR gate 74, as described hereinabove, so that capacitor 82 begins to charge up toward the threshold voltage $V_{th}$ of inverter 86, as indicated by waveform $P_A'$ in FIG. 2. When this threshold voltage level is attained, the output from inverter 86, i.e signal $P_B$, goes from the $V_{dd}$ to the $V_{ssH}$ potential. As a result, transistors 98 and 96 are turned from the ON to the OFF state, thereby isolating the negative voltage supply terminals 13, 15 and 17 of timebase oscillator circuit 12, frequency divider circuit 14 and timekeeping counter circuit 16 from the $V_{ssH}$ potential. At the same time, transistors 92 and 94 receive the $V_{dd}$ potential output from inverter 90 at their gate terminals, and so are turned to the ON state. The $V_{ssL}$ potential is thereby supplied through transistor 92 to the negative supply voltage terminals 13, 15 and 17 of timebase oscillator circuit 12, frequency divider circuit 14, and timekeeping circuit 16. The voltage now being supplied to operate timebase oscillator circuit 12, i.e. ($V_{dd}$–$V_{ssL}$), although less than the value ($V_{dd}$–$V_{ssH}$) will normally be sufficient for timebase oscillator circuit 12 to sustain oscillation operation, after having been initially triggered into oscillation by the supply voltage ($V_{dd}$–$V_{ssH}$).

At some subsequent time, it is possible that timebase oscillator circuit 12 may cease to oscillate, for some reason such as utilization of the timepiece in excessively high ambient operating temperature conditions. When this occurs, signal $P_2$ will of course cease to be produced by frequency divider circuit 14, so that voltage step-down circuit 22 will cease to function. However, there is no danger of information contained in the counter circuits of frequency divider 14 and timekeeping counter circuit 16 being lost at this time by a failure of supply voltage, before changeover circuit 88 comes into operation, since a sufficient amount of charge is stored in capacitor 11 to continue supplying the frequency divider circuit 14 and timekeeping counter circuit 16 for a short time. With the cessation of operation by timebase oscillator circuit 12, also, clock signal $P_3$ will also cease to be output from frequency divider circuit 14. Thus, the output $P_3$ will remain static at either the $V_{dd}$ or the $V_{ssL}$ level. As a result, signal $P_a$ produced by the level shifting section 56 of oscillation detection circuit 54 will remain static at either the $V_{dd}$ or the $V_{ssH}$ level, so that both of the inputs to exclusive-OR gate 74 will be at the same logic level potential. The output of exclusive-OR gate 74, i.e. signal $P_A$, will therefore go to the $V_{ssH}$ level, so that a $V_{dd}$ potential signal will be applied to the gate of P-channel transistor 80 of charge pump section 76. Transistor 80 will therefore be held in the OFF state continuously, so that capacitor 82 will rapidly discharge through resistor 84 to the $V_{ssH}$ potential, thereby rapidly falling below the threshold voltage $V_{th}$ of inverter 86. The output of inverter 86, i.e. signal $P_B$, will therefore go from the $V_{ssH}$ to the $V_{dd}$ potential. When this occurs, transistor 98 (and transistor 96) are turned to the ON state, while the output from inverter 90 turns transistor 92 (and transistor 94) to the OFF state. The $V_{ssH}$ potential is thereby again supplied through transistor 98 to the negative voltage supply terminals 13, 15 and 17 of timebase oscillator circuit 12, frequency divider 14 and timekeeping counter circuit 16. The high level of supply voltage now being applied to timebase oscillator circuit 12, i.e. ($V_{dd}$–$V_{ssH}$) causes timebase oscillator circuit 12 to begin oscillation once more.

The subsequent operation of the system will depend upon whether the condition which caused timebase oscillator circuit 12 to cease oscillation previously has improved, to the extent that continued operation by timebase oscillator circuit 12 is made possible. If this is the case, then the continued input of clock pulse signal $P_3$ to oscillation detection circuit 54 will cause signal $P_B$ to remain at the $V_{ssH}$ potential, so that changeover circuit 88 continues to supply the $V_{ssL}$ potential to timebase oscillator circuit 12, as well as frequency divider circuit 14, and timekeeping counter circuit 16. If, on the other hand, the condition which previously caused timebase oscillator circuit 12 to cease oscillation persists, then when the potential applied to terminal 13 of that circuit again reaches the $V_{ssL}$ level, timebase oscillator circuit 12 will once more cease oscillation. The time which elapses between this occurring and the point at which cessation of oscillation was previously detected will depend on various circuit values, and particularly upon the value of capacitor 11. In any case, if the condition which causes timebase oscillator circuit 12 to cease oscillation when a voltage ($V_{dd}$–$V_{ssL}$) is supplied to it should persist for an appreciable time, then it will be apparent that the voltage control system of the present invention will repetitively and alternately apply the $V_{ssH}$ and the $V_{ssL}$ potentials to the negative supply terminals of timebase oscillator circuit 12, frequency divider circuit 14 and timekeeping counter circuit 16. However, this alternating supply of the high and low supply voltage levels will not have a deleterious effect upon the operation of the timepiece, since there is no danger of timepiece oscillator circuit 12 being inoperative for any appreciable time duration.

The above can be summarized as follows, if the supply voltage level at which timebase oscillator circuit will start oscillating after having been in a non-oscillating condition is designated as $V_{start}$, and the supply voltage level at which timebase oscillator circuit 12 will cease oscillation after having been in the oscillating state is designated as $V_{stop}$. Firstly, the relationship between $V_{start}$ and $V_{stop}$ exists that $V_{start} > V_{stop}$. If, after oscillation has been started by supplying a voltage $(V_{dd}-V_{ssH}) > V_{start}$, a supply voltage $(V_{dd}-V_{ssH}) > V_{stop}$, or a supply voltage $(V_{dd}-V_{ssL}) > V_{start}$ or a supply voltage $V_{start} > (V_{dd}-V_{ssL}) > V_{stop}$ is applied to timebase oscillator circuit 12, then even if the ambient operating temperature should be rather low, the system will continue operation with the supply voltage $(V_{dd}-V_{ssL})$.

If on the other hand, the timepiece is operated under low ambient temperature conditions, and the relationship $(V_{dd}-V_{ssH}) > V_{start}$ exists, while the relationship $V_{start} > V_{stop} > (V_{dd}-V_{ssL})$, then the voltage control system will repetitively and alternately and repetitively supply the $(V_{dd}-V_{ssH})$ and the $(V_{dd}-V_{ssL})$ voltages to the timebase oscillator circuit 12, as described above.

Once the timepiece is restored to a normal ambient operating temperature condition, then the relationship $V_{start} > (V_{dd}-V_{ssL}) > V_{stop}$ will be restored, so that the voltage control system will thereafter supply the $V_{ssL}$ potential to negative supply voltage terminals 13, 15 and 17 of timebase oscillator circuit 12, frequency divider circuit 14 and timekeeping counter circuit 16.

In the preceding description, it has been assumed that a potential $V_{ssH}$ is supplied by changeover circuit 88 from the drain of transistor 98, however in fact this is only approximately equal to $V_{ssH}$ potential, since there will be a slight voltage drop across transistor 98. Similarly, when changeover circuit 88 is supplying a low potential output through transistor 92 to the negative supply voltage terminals 13, 15 and 17, this voltage will differ very slightly from the $V_{ssL}$ output voltage level appearing at terminal 52 of voltage step-down circuit 22. However, in either case the value of $V_{ssH}$ will be approximately 3 V for the present embodiment, while that of $V_{ssL}$ will be approximately 1.5 V.

The operation of changeover circuit 88 will now be described in greater detail, in order to clearly define an important feature of novelty of the present invention. This is a feature whereby the substrate voltage of transistor 92 is controlled in such a way as to virtually eliminate leakage current between the drain and source electrodes of transistor 92 when in the OFF state. This control is performed by means of the transistors 94 and 96, shown within the broken-line rectangle 93, in changeover circuit 88, and is performed in the following manner. First, it will be assumed that signal $P_B$ is at the high potential level, i.e. at potential $V_{dd}$. As a result, transistor 94 and transistor will be in the OFF state, due to the low level output from inverter 90, while transistors 96 and 98 are in the ON state. In this condition, the substrate 97 of transistor 92 is connected to the lowest potential level, i.e. $V_{ssH}$ through transistor 96 and transistor 98. At this time, the source electrode 91 of transistor 92 is at the $V_{ssL}$ potential, approximately, since it is connected to output terminal 52 of voltage step-down circuit 22, while the drain electrode 95 of transistor 92 is coupled to the $V_{ssH}$ potential, approximately, through transistor 98. At this time also, a potential $V_{ssH}$ is being applied to the gate electrode of transistor 92 from inverter 90. In this condition, the electrode 95 and the substrate 97 of transistor 92 are at the same potential, i.e. $V_{ssH}$ while electrode 91 is at the potential $V_{ssL}$ which is of course higher than $V_{ssH}$. In this condition, no leakage current will flow in transistor 92, since the electrode 95 to which substrate 97 is now connected is at the same potential as the gate electrode, while electrode 91 is at a higher potential than electrode 95 so that transistor 92 is now in the cut-off state.

It will next be assumed that signal $P_B$ is at the low potential level, i.e. at the $V_{ssH}$ level. In this case, transistors 96 and 98 will be in the OFF state, while the $V_{dd}$ potential output from inverter 90 causes transistors 92 and 94 to be in the ON state. In this condition, both the source and the drain electrodes 91 and 95 of transistor 92 will be at the $V_{ssL}$ potential, approximately, while substrate 97 of transistor 92 will be connected through transistor 94 to source electrode 91 of transistor 92, i.e. to the $V_{ssL}$ potential. In this condition, the gate electrode of transistor 92 is biased positively with respect to the source electrode 91, while substrate 97 is also connected to the source electrode 91. Thus, after the charge in capacitor 11 has fallen to the extent that the $V_{ssl}$ potential appears at the drain terminal 95 of transistor 92, (after a transition from the high to the low potential level of signal $P_B$), current will flow through transistor 92 from timebase oscillator circuit 12, frequency divider circuit 14, and timekeeping counter circuit 16.

If the control circuit 93 of changeover circuit 88 were not utilized, and the input and output of inverter 90 were simply connected to the gate electrodes of transistors 92 and 98 respectively, then if the substrate of transistor 92 were left permanently connected to either the drain or the source terminal 95 or 91, it will be apparent that a leakage current would flow in transistor 92 when in the OFF state, since in that state the source electrode 91 is biased positively with respect to the drain electrode 95.

Figure 3:
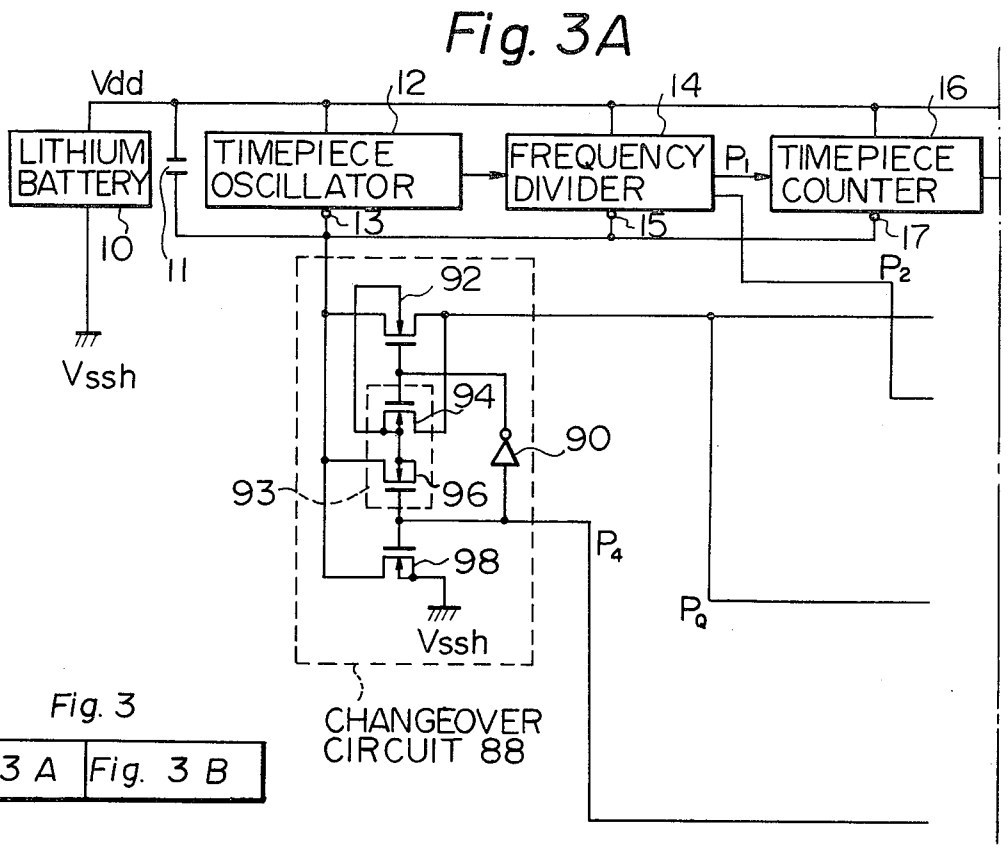
FIG. 3 (FIGS. 3A and 3B) is a circuit diagram of a second embodiment of the present invention.
Figure 3B:
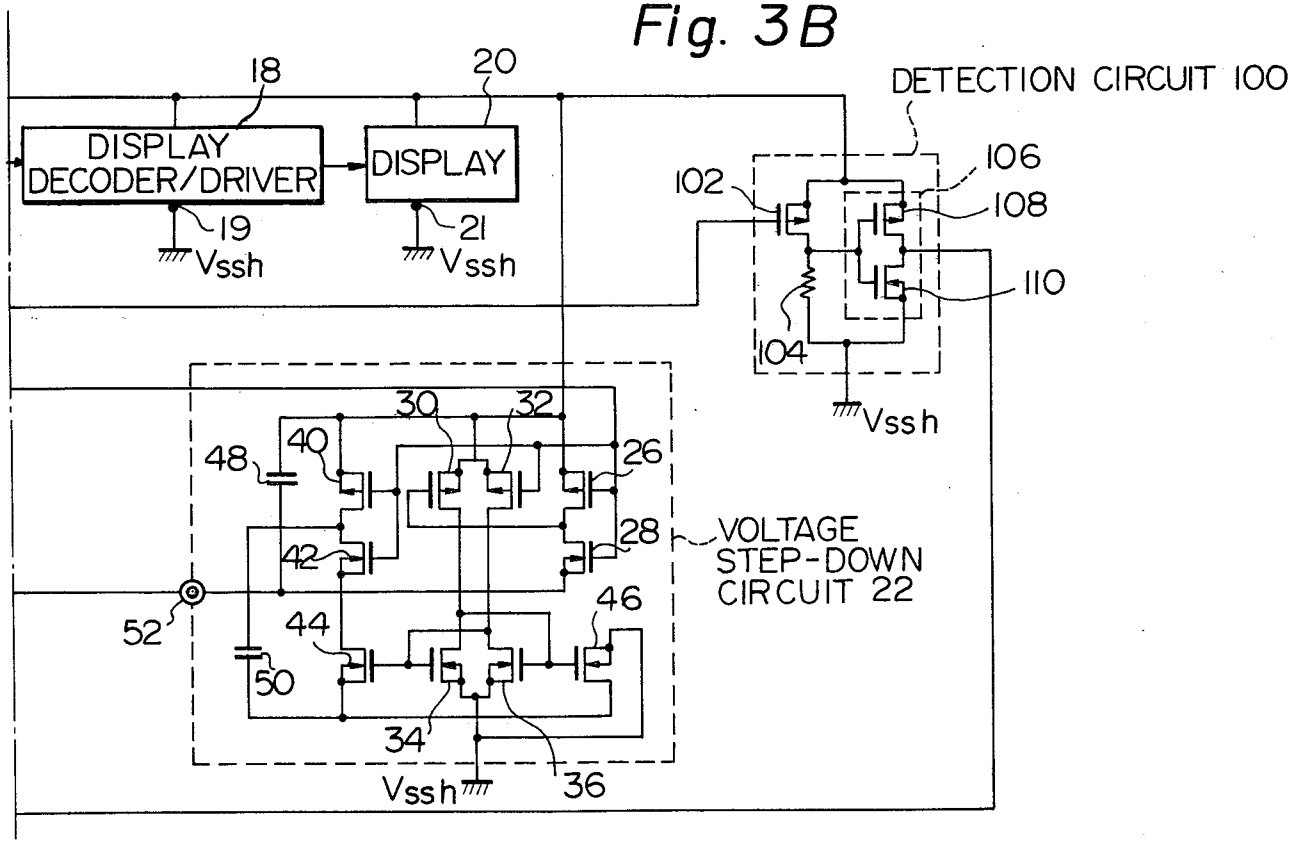

Referring now to FIG. 3, a second embodiment of an electronic timepiece incorporating a voltage control system according to the present invention is shown. In this second embodiment, the circuit arrangement of the control system is simplified somewhat by comparison with the first embodiment of FIG. 1, as a separate oscillation detection circuit 54 is not used. Instead, the voltage control system determines whether or not timebase oscillator circuit 12 is functioning by detecting the potential of the output signal from voltage step-down circuit 22, which will rise to the $V_{dd}$ level when clock pulse signal $P_2$ ceases to be supplied to it. In FIG. 3, reference numeral 100 denotes an oscillation detection circuit, comprising a P-channel MOS FET 102, a resistor 104 connected between the drain electrode of transistor 102 and the $V_{ssH}$ potential, and a CMOS FET inverter 106 comprising a P-channel FET 108 and an N-channel FET 110. The drain electrode of transistor 102 is connected to the input of inverter 106. The output of inverter 106, which produces control signal $P_B$ corresponding in function and polarity to control signal $P_B$ of the first embodiment of FIG. 1, is connected to the input of inverter 90 of changeover circuit 88. Apart from oscillation detection circuit 100, all other circuit components correspond in function and operation to the circuit components having the same reference numerals in the first embodiment of FIG. 1, described hereinabove.

The operation of the second embodiment of FIG. 3 is as follows. If, with lithium battery 10 inserted, timebase oscillator 12 should be inoperative for some reason, then clock signal $P_2$ will cease to be supplied to voltage step-down circuit 22. As a result, the potential of output terminal 52 of voltage step-down circuit 22 will attain the $V_{dd}$ potential level. Transistor 102 of oscillation detection circuit 100 will therefore enter the OFF state, so that a $V_{ssH}$ level signal will be applied to the input of inverter 106. The output of inverter 106, i.e. signal $P_B$, will therfore be at the high potential level, i.e. at $V_{dd}$, so that, as described hereinabove with respect to the embodiment of FIG. 1, changeover circuit 88 will apply the $V_{ssH}$ potential, through transistor 98, to the negative supply voltage terminals 13, 15 and 17 of timebase oscillator circuit 12, frequency divider 14 and timekeeping counter circuit 16.

When oscillation of timebase oscillator circuit 12 is thereby restarted, clock signal $P_2$ begins to be supplied to voltage step-down circuit 22, so that the potential at terminal 52 falls to the $V_{ssL}$ level. This turns transistor 102 of oscillation detection circuit 100 to the ON state, so that a voltage of level $V_{dd}$ is applied to the input of inverter 106. Signal $P_B$ therefore goes to the $V_{ssH}$ level, so that, as described with respect to the first embodiment, the $V_{ssL}$ potential is supplied through transistor 92 of changeover circuit 88 to the negative supply voltage terminals of timebase oscillator circuit 12, frequency divider circuit 14, and timekeeping counter circuit 16.

The second embodiment of FIG. 3 therefore functions, effectively, in a similar manner to the first embodiment of FIG. 1.

From the above description, it will be appreciated that a voltage control system according to the present invention provides a simple and effective means for utilizing a lithium type battery, of relatively high voltage, in an electronic timepiece. Detection of cessation of operation of the timebase oscillator circuit, due to any reason such as excessively low ambient operating temperature, is automatically and immediately detected, and a changeover made to applying a higher value of supply voltage to the timebase oscillator circuit. No manual operations are required, either at the time of insertion of a new battery, or during normal use by the timepiece user.

From the preceding description, it will be appreciated that the objectives set forth for the present invention are effectively attained. Since various changes and modifications to the above construction may be made without departing from the spirit and scope of the present invention, it is intended that all matter contained in the above description or shown in the accompanying drawings shall be interpreted as illustrative, and not in a limiting sense. The appended claims are intended to cover all of the generic and specific features of the invention described herein.

What is claimed is:

1. In an electronic timepiece powered by a lithium battery and having a timebase oscillator circuit for providing a standard frequency timebase signal, a frequency divider circuit for dividing the frequency of said timebase signal to provide a unit time signal and to provide at least one clock pulse signal comprising a pulse train of higher frequency than said unit time signal, a timekeeping counter circuit for counting said unit time signal, time display means for displaying time information produced by said timekeeping counter circuit, and a voltage control circuit for controlling the value of a supply voltage applied to power said timebase oscillator circuit, comprising:

oscillation detection circuit means for detecting the operating condition of said timebase oscillator circuit, and for providing a control signal indicative of whether said timebase oscillator circuit is in an oscillating or in a non-oscillating state;

voltage step-down circuit means producing a stepped-down voltage having a value lower than the output voltage of said lithium battery; and changeover circuit means responsive to said control signal for applying said stepped-down voltage to a supply voltage terminal of said timebase oscillator circuit for powering said timebase oscillator circuit when said control signal is in a first state which indicates that said timebase oscillator is in an oscillating condition, and for applying said output voltage of said lithium battery to said supply voltage terminal to power said timebase oscillator circuit when said control signal is in a second state which indicates that said timebase oscillator is in a non-oscillating condition.

2. A voltage control circuit according to claim 1, wherein said stepped-down voltage from said changeover circuit is further applied to power said frequency divider circuit and said timekeeping counter circuit simultaneously with being applied to power said timebase oscillator circuit.

3. A voltage control circuit according to claim 1, wherein said changeover circuit means includes a first field-effect transistor responsive to said control signal from said oscillation detection circuit means for selectively supplying said stepped-down voltage to and disconnecting said stepped-down voltage from said timebase oscillator circuit, and control circuit means responsive to said control signal for selectively connecting a substrate of said first field effect transistor to a source electrode and to a drain electrode of said first field effect transistor.

4. A voltage control circuit according to claim 3, wherein said changeover circuit means further comprises an inverter circuit and a second field effect transistor, said second field effect transistor being responsive to said second state of said control signal for applying said output voltage of the lithium battery to power said timebase oscillator circuit, said inverter circuit being coupled to receive said control signal, and wherein said control circuit means comprises a third and a fourth field effect transistor, said third field effect transistor being responsive to said control signal inverted by said inverter circuit for connecting said substrate of the first field effect transistor to the drain terminal thereof when said control signal is in said second state, and said fourth field effect transistor being responsive to said control signal for connecting said substrate of said first field effect transistor to the source terminal thereof when said control signal is in said first state, said first field effect transistor being responsive to said inverter circuit output for applying said stepped-down voltage to power said timebase oscillator circuit when said control signal is in said first state.

5. A voltage control circuit according to claim 2, wherein said voltage step-down circuit means comprises circuit means responsive to said clock pulse signal for producing said stepped-down voltage, and wherein said oscillation detection circuit means comprises circuit means responsive to said stepped-down voltage output from said voltage step-down circuit for producing said control signal in said first state thereof, and further for producing said control signal in said second state thereof in the absence of said stepped-down voltage from said voltage step-down circuit.

6. A voltage control circuit according to claim 1, wherein said oscillation detection circuit means comprises charge pump circuit means including a capacitor, responsive to said clock pulse signal from said frequency divider circuit for charging said capacitor to a predetermined potential, and threshold detection means for detecting the potential appearing across said capacitor, said threshold detection means producing said control signal in said first state thereof when said capacitor potential is above a predetermined threshold level, and further producing said control signal in said second state thereof when said capacitor potential is below said predetermined threshold level.

7. A voltage control circuit according to claim 6, wherein said oscillation detection circuit means further comprises exclusive-OR logic gate circuit means coupled to receive said clock signal pulses at one input terminal thereof and integrator circuit means for integrating said clock signal pulses, the output signals from said integrator circuit means being applied to a second input terminal of said exclusive-OR logic gate circuit means, output signals from said exclusive-OR logic gate circuit means being applied to said charge pump circuit means, whereby a train of pulses of short pulse width is produced from said exclusive-OR gate while said clock pulse signal is being produced from said frequency divider circuit means, and whereby the output of said exclusive-OR logic gate circuit means goes to a predetermined fixed potential both when output of said clock pulse signal from said frequency divider circuit ceases and is replaced by an output at a fixed high potential and when said clock pulse signal ceases and is replaced by an output at a fixed low potential.

8. A voltage control circuit according to claim 7, wherein said oscillation detection circuit means further comprises level shifting circuit means coupled to receive said clock pulse signal from said frequency divider circuit, for thereby supplying a clock pulse signal of predetermined amplitude to said integrator circuit and said exclusive-OR logic gate input terminal both when said frequency divider circuit is being powered by said output voltage of the lithium battery and by said stepped-down voltage from said voltage step-down circuit.

9. A voltage control circuit according to claim 1, wherein said voltage step-down circuit means comprises first and second capacitors of equal capacity value, and switching means responsive to said clock pulse signal for repetitively and alternately connecting said capacitors in a first condition in which said capacitors are in parallel with one another with one terminal of each of said capacitors connected in common to one terminal of said lithium battery, and a second condition in which said capacitors are connected in series across said lithium battery.

10. A voltage control circuit according to claim 1, and further comprising a capacitor coupled between said supply voltage terminal of the timebase oscillator circuit and a terminal of said lithium battery.

* * * * *